United States Patent [19]

Palac

[11] Patent Number: 4,614,892

[45] Date of Patent: Sep. 30, 1986

[54] TENSION MASK MOUNTING STRUCTURE

[75] Inventor: Kazimir Palac, Carpentersville, Ill.

[73] Assignee: Zenith Electronics Corporation, Glenview, Ill.

[21] Appl. No.: 646,861

[22] Filed: Aug. 31, 1984

[51] Int. Cl.[4] ..... H01J 29/81; H01J 31/00; H01J 1/90; H01J 1/46

[52] U.S. Cl. ..... 313/402; 313/407; 313/482; 313/477 R; 313/284; 313/348

[58] Field of Search ..... 313/402, 407, 269, 283, 313/284, 292, 477 R, 482, 348, 349, 258; 220/2.1 A

[56] References Cited

U.S. PATENT DOCUMENTS

| | | | |
|---|---|---|---|
| 2,625,734 | 1/1953 | Law | 445/4 |
| 2,761,990 | 9/1956 | Amdursky et al. | 313/417 |
| 2,813,213 | 11/1957 | Cramer et al. | 313/78 |
| 2,842,696 | 7/1958 | Fischer-Colbrie | 313/78 |
| 2,905,845 | 9/1959 | Vincent | 313/78 |
| 3,284,655 | 11/1966 | Oess | 313/286 |
| 3,440,469 | 4/1969 | Bradu et al. | 313/482 |
| 3,489,966 | 1/1970 | Bradu et al. | 313/83 |
| 3,638,063 | 1/1972 | Tachikawa et al. | 313/348 |
| 3,719,848 | 3/1973 | Bradu | 313/402 |
| 3,873,874 | 3/1975 | Shinal | 313/402 |
| 3,894,321 | 7/1975 | Moore | 445/30 |
| 3,898,508 | 8/1975 | Pappadis | 313/405 |
| 4,069,567 | 1/1978 | Schwartz | 445/50 |
| 4,495,437 | 1/1985 | Kume et al. | 313/403 |

FOREIGN PATENT DOCUMENTS

| | | | |
|---|---|---|---|
| 23941 | of 1971 | Japan . | |
| 0141148 | 11/1981 | Japan | 313/482 |
| 1163495 | 9/1969 | United Kingdom . | |

*Primary Examiner*—David K. Moore
*Assistant Examiner*—M. Razavi
*Attorney, Agent, or Firm*—Cornelius J. O'Connor

[57] ABSTRACT

An improvement in a tension mask type color cathode ray tube comprising an envelope funnel that includes a bell portion, one extremity of which has a sealing land. The tube further comprises a flat face panel formed of a material having a predetermined temperature coefficient of expansion. The panel has a target area adapted to receive a pattern of luminescent color phosphor deposits. A sealing surface circumscribes the target areas. The improvement concerns a constituent structure which is disposed between the funnel sealing land and the panel sealing surface and which is frit sealed therebetween. The structure defines a central opening which is dimensioned to enclose the panel target area and it is formed of a material having a temperature coefficient of expansion approximating that of the face panel. The structure itself comprises means which define a support surface that confronts the target, which surface is adapted to fixedly receive a tensed color selection mask. Additionally, the structure includes means that serve to establish the tensed mask at a predetermined Q distance from the target area.

8 Claims, 2 Drawing Figures

TENSION MASK MOUNTING STRUCTURE

CROSS-REFERENCE TO RELATED APPLICATIONS

This application is related to but in no way dependent upon U.S. Pat. Nos. 4,593,224 filed Sept. 30, 1983; 4,547,696 and 4,595,857 both filed Jan. 18, 1984; and 4,593,225, filed Aug. 31, 1984; all of common ownership herewith.

BACKGROUND OF THE INVENTION

This invention relates in general to color cathode ray tubes, and to an improved constituent structure for supporting a tensed color selection electrode between the funnel and face panel of such a tube.

In general, a color selection electrode or "shadow mask" is a device which is disposed adjacent the luminescent phosphor screen, that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas only by appropriately assigned beams. The choice of a color selection electrode for use in color television cathode ray tubes is, by and large, a choice between a spherical or biradial electrode and a cylindrical electrode tensed upon a heavy spring frame—both types being supported within the tube envelope. The most common type of color selection electrode used in color television receivers today is the conventional curved type.

In color picture tubes utilizing a conventional shadow mask, there is a tendency on the part of the mask to "dome" (localized buckling) in those areas where a scene characterized by very high brightness is depicted. For example, in a scene where a high concentration of light is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", a conventional mask cannot accommodate the power density that a "doming-resistant" tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bi-metallic support springs; however, such provision can not resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color television manufacturer. In that tube, the color selection electrode comprises a grid formed of a multitude of parallel conductors tensed across a spring frame suspended conventionally within the tube. This grid serves to mask the writing beams in such a fashion that they fall upon the desired light emitting phosphor.

In the afore-mentioned cylindrical faceplate tube, the mask supporting frame is mechanically stressed, as by compressing it, prior to attaching the shadow mask thereto. Upon release of the compression force, restoration forces in the frame establish tension in the mask. However, because of the tension in these tautly stretched conductors, provision must be made to prevent, or counter, any mechanically or thermally induced vibration of the conductors, which vibration, of course, would severely degrade a reproduced image.

An advantage of utilizing any tensed mask resides in the fact that the mask, while under tension, will not "dome". A tensed mask retains its desired configuration under normal operating conditions. A cathode ray tube utilizing a tensed grid mask of the type adverted to above is described in U.S. Pat. No. 3,638,063.

The color television cathode ray tube in most common usage today employs a faceplate which approximates a section of a large radius sphere. The shadow mask in such a tube, of course, is contoured to match the faceplate. A trend today is toward a flatter faceplate which, in turn, calls for a flatter shadow mask. However, a flat mask is inherently less mechanically stable than a curved mask. Accordingly, to acquire stability, resort is had to a thicker mask, for example, one having a thickness in the order of 10 to 12 mils. This is approximately twice the thickness of a conventional curved mask. However, when one goes to a 10 to 12 mil mask the aperture etching process is much more difficult. Specifically, in order to prevent aperture limiting of the beam at the outer reaches of the mask, as would be encountered in a 90 degree tube, the apertures have to be etched at an angle to the plane of the mask, rather than etched substantially perpendicular to that plane as is the case for a conventional curved mask.

DISCUSSION OF OTHER PRIOR ART

An early example of tensed shadow mask for use in a color television cathode ray tube is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 3,284,655—Oess is concerned with a direct viewing storage cathode ray tube employing a mesh storage target which is supported in a plane perpendicular to the axis of the tube. The mesh target comprises a storage surface capable of retaining a charge pattern which, in turn, controls the passage therethrough of a stream of electrons. From a structural standpoint, it is proposed that the mesh storage screen be affixed (no details given) to a circumferential ring that is disposed across the open end of an envelope section of the tube. One end of the ring is in contact with an edge of that envelope section which has a coating of glass frit applied thereon. The end wall of another envelope section, also coated with frit, is placed in contact with the other side of the ring so that the end walls of the envelope sections now abut both sides of the ring. Thereafter this assembly is frit sealed to secure the ring and mesh target within the tube.

It is of particular signficiance that the electrode spanning the inside of the tube envelope is a mesh screen that is not said to be subject to tension forces. Moreover, the mesh screen is not a color selection electrode that serves to direct a writing beam to selected elemental areas of color phosphors. Finally, there is no criticality, perceived or discussed, as respects mesh target registration with the phosphor layer on the faceplate.

British Pat. No. 1,163,495 describes the use of a flat apertured metal mask which is sealed between the face of the tube and its cone. The periphery of the mask is formed to provide a plurality of outwardly directed narrow tabs (0.2 to 0.5 mm wide) which, when sealed to the bulb wall provide the sole support for the mask. By way of introducing background, the patent decrys the industry practice of "tailor-making" the luminescent screen by "marrying" a mask to the screen it was employed to make. It is suggested that such "tailoring" be avoided by making the mask and screen ". . . separately with the utmost precision." It is the thrust of the patent that the tabs serve as tension exerting springs to maintain the mask flat. The disclosure is silent as to how registration between this flat mask and the luminescent screen is to be achieved.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially disclosed but simply textually referred to, an arrangement is proposed comprising a glass donut-shaped structure into which the grid wires are sealed. This donut assembly is then inserted between the faceplate of the tube ands its conical section. Thereafter, the patent notes, after the tube is assembled, the phosphors may be deposited on the faceplate by conventional photographic processes. The application of elemental color phosphor areas to the faceplate of a tube is, in itself, a formidable task.

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In one embodiment, the front panel is shown as having an inner ledge forming a continuous path around the tube, the top surface of which is a Q-distance away from the faceplate for receiving the foil mask such that the mask is sealed within the tube envelope. In another embodiment, an inner ledge is shown extending from the funnel for receiving the mask. An embodiment is also shown in which the faceplate is skirtless and essentially flat.

Other examples of the prior art practice of utilizing a tensioned grid-type structure in a cathode ray tube environment are described in the following U.S. Pat. Nos. 2,842,696, 2,905,845, 3,489,966, and 3,719,848 2,761,990, 3,440,469, 3,873,874, 3,894,321, 4,069,567, and 4,495,437.

Finally, and by way of emphasizing the extent to which the invention to be described departs from the prior art, attention is directed to U.S. Pat. No. 3,898,508 which shows and describes a faceplate and shadow mask (untensed) assembly representative of current practice.

OBJECTS OF THE INVENTION

Accordingly, it is a general object of the invention to provide an improved constituent structure for supporting a tensed color selection electrode in a color cathode ray tube.

It is a specific object of the invention to provide a tensed shadow mask support structure insertable as a constituent between the face panel and the funnel of a color cathode ray tube.

If is still another object of the invention to provide a planar tensed mask structure which is readily amenable to conventional color tube photoscreening procedures.

It is also an object of the invention to provide a color television cathode ray tube which, in adopting the improved tensed mask structure, offers significant economic and performance advantages over prior art tubes.

DESCRIPTION OF A PREFERRED EMBODIMENT

Figure 1:
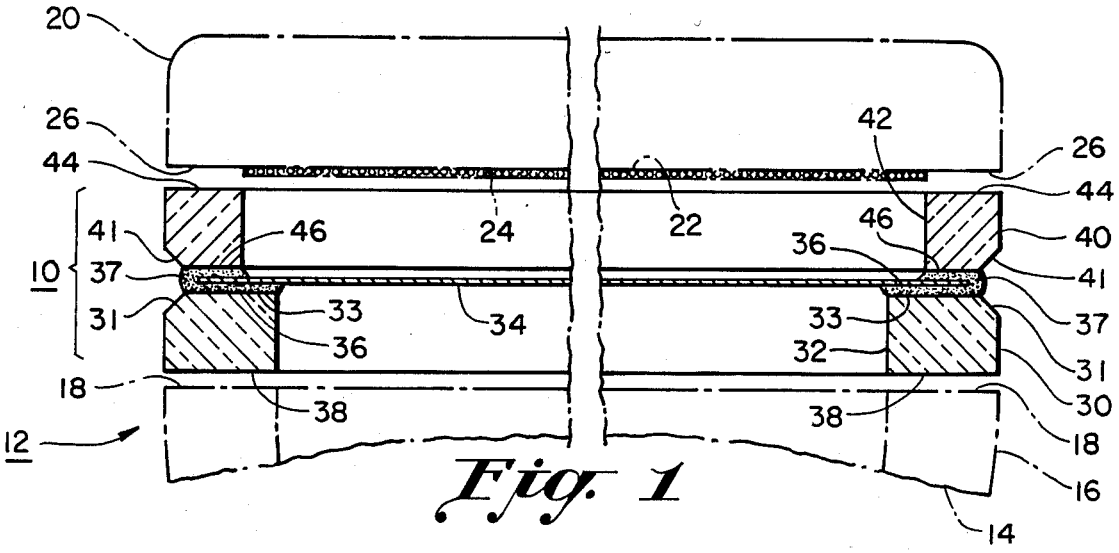
FIG. 1 is an exploded sectioned view of a portion of a color cathode ray tube embodying a constituent structure for supporting a tensed color selection mask.

An improvement, comprising a constituent structure 10, for use in a tension mask color cathode ray tube 12 is highlighted in FIG. 1. Tube 12 comprises an envelope funnel 14 (only partially illustrated) having a central axis and including a bell portion 16. The depicted extremity of bell portion 16 has a predetermined wall thickness and it comprises a sealing land 18. The funnel is formed of a material having a predetermined temperature coefficient of expansion.

Additionally, tube 12 comprises a flat, substantially rectangular, glass face panel 20 formed of a material having a like predetermined temperature coefficient of expansion. Panel 20 comprises a target area 22 having a patterned screen 24 of luminescent primary color elemental phosphor deposits thereon, which deposits may be arranged in triads of red, green, and blue phosphor dots. Alternatively, the screen may adopt the line screen format in which the phosphor deposits are formed as stripes, rather than dots. In any event, a sealing land 26 circumscribes target area 22.

Figure 2:
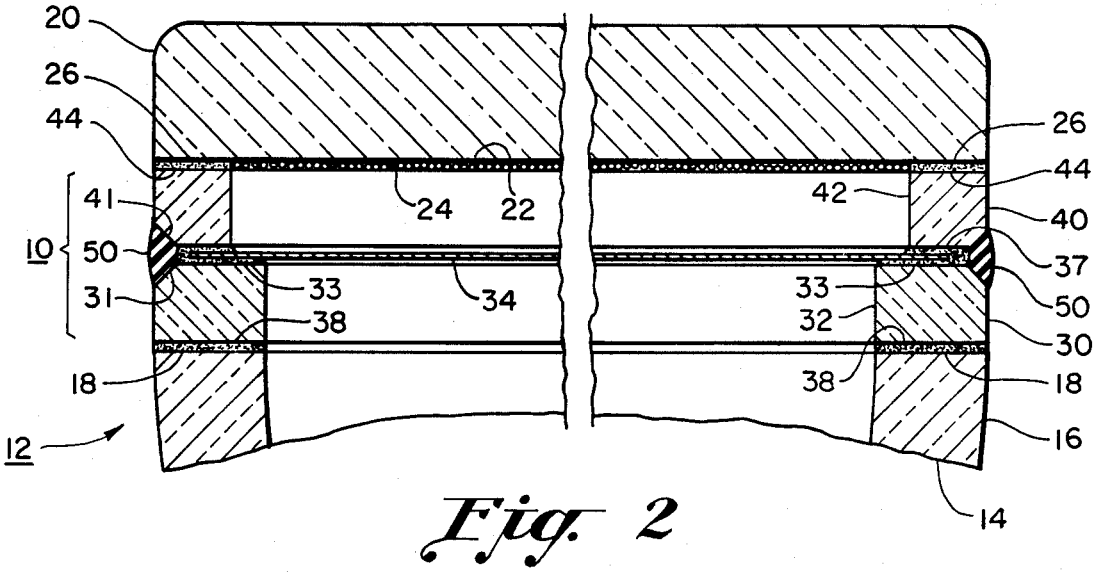
FIG. 2 is a sectioned view of a color cathode ray tube showing a preferred embodiment of the mask supporting structure in FIG. 1.

The constituent structure 10 shown in FIG. 1 is insertable between funnel sealing land 18 and panel sealing land 26 and, as depicted in FIG. 2, is frit sealable therebetween. Structure 10 permits selective excitation of the phosphor deposits by a scanning beam of electrons and, to that end, is centrally apertured to afford such a beam access to phosphor screen 24. Structure 10 is formed of a material having a temperature coefficient of expansion approximating that of funnel 14 and panel 20.

Structure 10 comprises means in the form of a frame member 30 having a substantially rectangular outer contour spatially coextensive with the contour of the immediately adjacent portion of bell section 16 of the envelope funnel and, of course, coextensive with the contour of the face panel 20. Frame 30 is characterized by a substantially rectangular central opening, or window 32, dimensioned to enclose panel target 22. To this end, frame 30 can adopt the form of a section of a rectangular assembly. For a purpose to be made apparent, the upper outside boundary of frame 30 (as viewed in FIG. 1) is cut away to afford the frame a circumferentially disposed outwardly directed bevel 31.

Frame 30 defines a flat support surface 33 which confronts target area 22 and it is adapted to fixedly receive a tensed color selection electrode in the form of a tensed planar foil 34 having a predetermined pattern of apertures which, in one execution of the invention, can be triads of minute circular holes. In any event, whatever execution is selected, the aperture pattern, of course, would correspond to the pattern of phosphor deposits forming screen 24 on face panel target area 22. Foil 34 has a temperature coefficient of expansion which is greater than that of frame 30. Thus, foil 34 can be formed from cold rolled steel when frame 30 is formed from glass. In a fashion to be explained, the peripheral portion of foil 34 is bonded to the surface of support 33 by a bead of frit, a devitrifying glass adhesive employed in fabricating cathode ray tubes. As will be seen, support surface 33 also constitutes a sealing land. The manner in which a foil can be tensed and frit bonded to a glass frame is fully described in referent U.S. Pat. No. 4,593,224, filed Sept. 30, 1983 in the name of Kazimir Palac. Further reference to this Palac teaching will be made below.

Frame 30 further includes a sealing land 38 which is intended to confront the sealing land 18 of bell portion 16 of the envelope funnel. As noted, and as dipicted in the drawings, the outer peripheral portion of frame 30, immediately adjacent funnel sealing land 18, is spatially coextensive with the contiguous section of the bell portion of the funnel. Moreover, in this regard, it is desirable that the transverse wall thickness of frame 30 substantially match the wall thickness of the aforesaid contiguous section of the bell. The axial thickness of the frame wall must be sufficient to accommodate the forces applied to the frame by the tensed foil.

Constituent structure 10 also comprises means, in the form of a second frame member 40, having an axial thickness that serves to establish foil 34 at a predetermined Q distance from target area 22 on face panel 20. More particularly frame 40 has a substantially rectangular outer contour matching that of frame 30 and panel 20, in other words, frame 40 is spatially coextensive with panel 20 and frame 30. However, the rectangular central opening, or window 42, of frame 40 is measurably larger than opening 32 in frame 30 in order to permit the foil support surface 33 and, of course, foil 34 to confront panel target area 22. As shown, frame 40 comprises a pair of flat, spaced-apart, parallel surfaces 44, 46 which constitute sealing lands. Surface 44 faces sealing land 26 of face panel 20 while surface 46 registers with the sealing land portion of foil support surface 33. The lower outside boundary of frame 30 (as viewed in FIG. 1) is cut away, in the same manner as frame 30 is cut, to provide frame 40 with a circumferentially disposed bevel 41, which bevel is disposed in a confronting relation to bevel 31. Accordingly, when frame 40 is interposed between panel 20 and foil support frame 32, the spacing between sealing lands 44, 46, in other words the thickness of frame 40, serves to establish foil 34 at the prescribed Q distance from target area 22.

The manner in which constituent structure 10 is fabricated for subsequent incorporation into a color cathode ray tube, as shown in FIG. 2, will now be described. A sheet of foil 34, having a length and breadth sufficient to completely overlay support surface 33 of frame member 30, is attached to a metal mount, which mount serves to maintain the foil in a taut condition. Thereafter an application of a glass sealable metal alloy, or frit 36, is deposited on surface 33 of frame 30. It is desirable to avoid applying any frit material to the bevel 31 of that frame.

A second quantity of frit material 37 is applied either to the sealing land 46 of frame 40 or, the frit may be applied to that surface of foil 34 that confronts sealing land 46. Then the frame members and foil are securely clamped together and subjected to an elevated temperature which establishes the foil in tension and devitrifies the frit material so that the foil is permanently secured, in tension, between frame members 30 and 40. Thereafter, the foil material extending into the confronting beveled edges of frame 30 and 40 is removed. The cavity formed by the bevels is subsequently filled with an insulating material for a purpose explained below.

The constituent structure 10, now comprising a bonded package of frame members 30 and 40 and a tensed planar foil 34, is utilized to develop a luminescent phosphor screen 24 on target surface 22 of the face panel. This tensed electrode assembly 10 is seated upon face panel 20 by a registration arrangement (not shown). A series of slurry coatings are applied to the face panel, sequentially, and individually exposed by a source of actinic light and washed to affix primary color phosphor deposits to the target of panel 20.

After the screening process has been completed, frit is applied to the sealing land 44 of frame 40 and to sealing land 38 of frame 30. Alternatively, the frit material could be applied to sealing lands that register with the aforesaid lands, that is, the frit may be applied to sealing land 26 of face panel 20 and to sealing land 18 of the funnel bell portion. In any event, after the frit application the tensed foil structure 10 is registered between face panel 20 and funnel and bell portion 16 of the funnel. This assembly is then inserted into a heat chamber the temperature of which is elevated to approximately 430 degree cenitgrade and maintained thereat for the requisite time period. After the frit has devitrified, constituent structure 10 will be captured between face panel 20 and bell portion 16 of the funnel to form an integral part of cathode ray tube 12. Thereafter, when the assemblage cools to room temperature and all materials have returned to their normal dimensions, foil 34 will remain tensed by virtue of its capture between frame members 30 and 40 whilie the structure 10 will remain permanently bonded between panel 20 and the funnel with tensed foil 34 in registration with luminescent screen 24.

At this juncture, the cavity formed by bevels 31, 41 of frame members 30 and 40, respectively, can be filled with an insulating material 50, such as a room temperature vulcanizing compound. This insulation, is for the purpose of preventing the high voltage subsequently borne by the foil from being exposed to the outside of the tube.

The inventive teaching is applicable, with but minor departures from the disclosed structure, to a cathode ray tube employing a face panel that comprises a section of a cylinder, with the minor axis of that face panel being disposed parallel to an axis traversing the geometric center of rotation of such a cylinder. In such an embodiment, is it appreciated that the color selection electrode, or foil, would adopt the configuration of a curvilinear plane conforming to the geometry of the cylindrical face panel.

While a particular embodiment of the invention has been described, it will be obvious to those skilled in the art that changes and modifications may be made without departing from the invention in its broader aspects, and, therefore, the aim of the appended claims is to cover all such changes and modifications as fall within the true spirit and scope of the invention.

I claim:

1. In a tension mask color cathode ray tube comprising an envelope funnel having a central axis and including a bell portion, one extremity of which has a sealing land, a flat or cylindrical face panel formed of a material having a predetermined temperature coefficient of expansion and having a target adapted to receive a pattern of luminescent primary color elemental phosphor areas and a sealing surface circumscribing said target:

the improvement comprising a constituent structure formed of a non-conductive material and disposed between said funnel sealing land and said panel sealing surface and sealed therebetween, defining a central opening dimensioned to enclose said panel target and formed of a material having a temperature coefficient of expansion approximating that of said face panel;

said structure comprising means defining a support surface confronting said target and fixedly receiving a tensed foil color selection electrode;

said structure including means that serve to establish said fixedly received color selection electrode at a predetermined Q distance from said target.

2. The improvement as set forth in claim 1 in which said color selection electrode comprises a planar foil.

3. The improvement as set forth in claim 1 in which said color selection electrode is formed of a material having a temperature coefficient of expansion greater than that of said constituent structure.

4. The improvement as set forth in claim 1 in which a peripheral portion of said means serving to establish said Q distance is substantially spatially coextensive with the periphery of said face panel.

5. The improvement as set forth in claim 1 in which a peripheral portion of said means defining said support surface is substantially spatially coextensive with the periphery of said bell extremity having said sealing land.

6. The improvement as set forth in claim 1 in which said means defining a support surface for said tensed electrode comprises a centrally disposed window and said means serving to establish said Q distance comprises a centrally disposed window coaxially aligned with said window of said means defining said support surface.

7. The improvement as set forth in claim 6 in which said window of said means serving to establish said Q distance exhibits a greater cross-sectional opening than said window of said means defining said support surface.

8. A tension mask color cathode ray tube comprising:

an envelope funnel having a central axis and including a bell portion, one extremity of which has a sealing land;

a flat face panel formed of a material having a predetermined temperature coefficient of expansion and comprising a target surface having a pattern of luminescent primary color elemental phosphor areas deposited thereon and a peripheral sealing area circumscribing said target surface which is substantially narrower in width than said funnel sealing land; and a color selection electrode assembly permitting selective excitation of said phosphor areas by a scanning beam of electrons comprising a planar tensed foil formed of a material having a temperature coefficient of expansion greater than that of said panel and having a predetermined pattern of apertures;

a constituent structure formed of a non-conductive material and disposed between said funnel sealing land and said panel sealing area and frit sealed therebetween to form an integral part of the tube envelope and defining a central opening dimensioed to enclose said target of said face panel and formed of a material having a temperature coefficient of expansion approximating that of said face panel, said structure comprising means defining a support surface confronting said target and adapted to fixedly receive said tensed foil, said constituent structure having forward and rear sealing lands adapted to be sealed to said face panel sealing area and said funnel sealing land, respectively, said forward sealing area being substantially narrower in width than said rear sealing land.

* * * * *